US006077037A

United States Patent [19]

Schmidt

[11] Patent Number: 6,077,037

[45] Date of Patent: Jun. 20, 2000

[54] QUICK-CHANGE FAN MECHANISM

[75] Inventor: Martin C. Schmidt, Burnsivlle, Minn.

[73] Assignee: Lockheed Martin Corporation, Bethesda, Md.

[21] Appl. No.: 09/266,850

[22] Filed: Mar. 12, 1999

[51] Int. Cl.[7] ..... F04D 29/64

[52] U.S. Cl. ..... 415/213.1; 415/214.1; 415/220; 24/546; 248/222.12

[58] Field of Search ..... 415/213.1, 214.1, 415/220; 416/247 R, 244 R; 248/222.11, 222.12, 300, 231.81; 24/546, 552, 555

[56] References Cited

U.S. PATENT DOCUMENTS

| | | | |
|---|---|---|---|
| 173,694 | 2/1876 | Upham | 24/546 |
| 736,935 | 8/1903 | Chandler | 24/555 |
| 2,620,127 | 12/1952 | Radcliffe | 416/247 R |
| 2,997,763 | 8/1961 | Serfass | 24/546 |
| 3,120,044 | 2/1964 | Di Piano | 24/555 |
| 3,194,248 | 7/1965 | Callies | 24/546 |
| 4,598,894 | 7/1986 | Johannes | 248/222.11 |
| 4,834,615 | 5/1989 | Mauch et al. | 415/213.1 |

FOREIGN PATENT DOCUMENTS

| | | | |
|---|---|---|---|
| 2554391 | 6/1976 | Germany | 24/546 |
| 93/04289 | 3/1993 | WIPO | 415/213.1 |

*Primary Examiner*—Christopher Verdier
*Attorney, Agent, or Firm*—Glenn W. Bowen; Patrick M. Hogan

[57] ABSTRACT

A mechanism for securing an electrical fan assembly to a frame is provided by a frame constructed with a generally flat frame peripheral section that surrounds a generally four-cornered rectangular opening at a fan support location. Two spaced-apart tabs punched out of the frame project into holes in the corners of the fan assembly, and two spaced-apart U-channel ribs formed from the frame engage the fan assembly housing when it is supported at the fan-support location. The frame has a wall that extends away from the frame which has a pair of spaced-apart slots. A resilient spring clip is associated with each of the slots so that a lip of the spring clip is clamped over a hole in a corner of the front of the fan assembly housing. An elongated straight side clip then extends to the associated slot where a generally J-shaped section of the clip is inserted into the slot by the application of force to the longer leg of the J-shaped section so that when the pressure is released the spring clip is retained in the slot.

1 Claim, 5 Drawing Sheets

QUICK-CHANGE FAN MECHANISM

FIELD OF THE INVENTION

This invention relates to mechanisms for securing cooling fan assemblies to frames, and in particular to mechanisms that allow for the rapid removal of defective fan assemblies and the substitution of non-defective ones.

BACKGROUND OF THE INVENTION

Rectangular, electric fan assemblies having a relatively narrow depth dimension are in common use to air-cool critical electronic and other components. One or more fans of this type may be mounted on a frame of a piece of electronic equipment to provide the cooling required to keep the electronic equipment operating properly without failure due to excessive heat. Fans used in electronic equipment must often operate continuously, or for long periods of time, and a fan that fails must, therefore, be replaced in a minimum of time. It is also desirable to be able to remove a defective fan without the use of any tools since the unavailability of the tool could delay the replacement of the fan, resulting in unnecessary down-time of the equipment, or in increasing the risk of heat-related problems if the equipment is still operating.

The present invention provides for rapid replacement of defective fans without the use of any tools.

SUMMARY OF THE INVENTION

A mechanism for securing one or more electrical fan assemblies which have a generally rectangular-shaped block housing with a front edge that has a hole in each of two spaced-apart corners, and a first back edge that has a hole in each of two spaced-apart corners is provided by a frame and a pair of spring clips. The frame is constructed with a generally flat frame peripheral section that surrounds a generally four-cornered rectangular opening at a fan support location. Two spaced-apart tabs are punched out of said frame and are inserted into one of the holes in one of the corners of the back edge of the fan assembly. Two spaced-apart U-channel ribs formed from the frame engage a limited portion of the back edge of the fan assembly. The frame also has a wall that extends away from said frame that has a pair of spaced-apart slots in it. A resilient spring clip is aligned so that a lip of the spring clip is clamped over the hole in the corner of the front of the fan assembly. An elongated straight side extends to its associated slot. A generally J-shaped section of the clip is inserted into the slot by the application of force to reduce the spacing between the legs of the J-shaped section so that when said pressure is released, the spring clip is retained in the associated slot.

BRIEF DESCRIPTION OF THE DRAWINGS

The present invention is described by reference to the drawings in which.

DESCRIPTION OF THE PREFERRED EMBODIMENT

Figure 1:
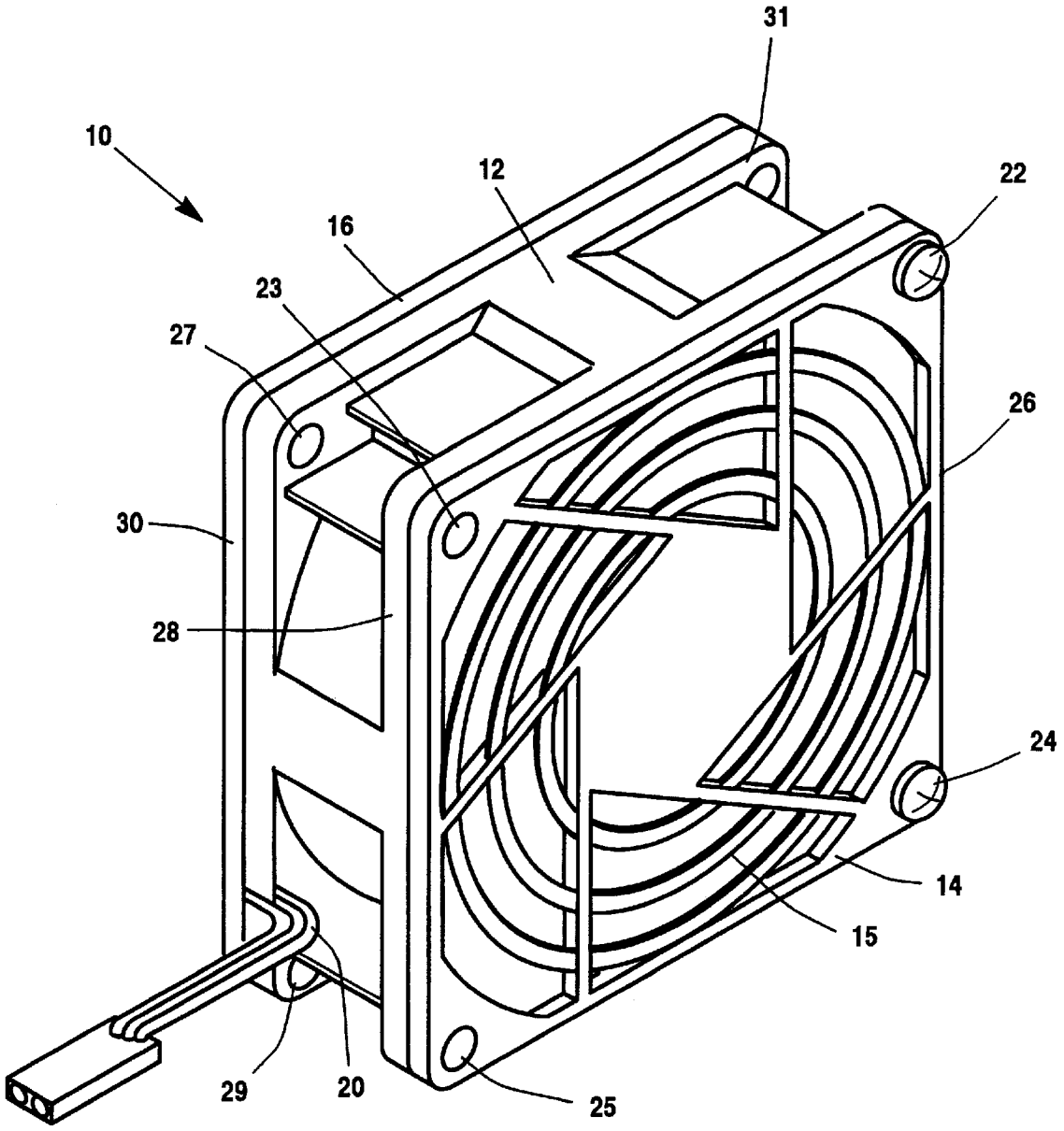
Figure 1 Prior Art
FIG. 1 is an isometric view of a prior art electric fan assembly that may be secured to the housing or frame of a piece of electrical equipment in accordance with the teachings of the present invention.
Figure 3:
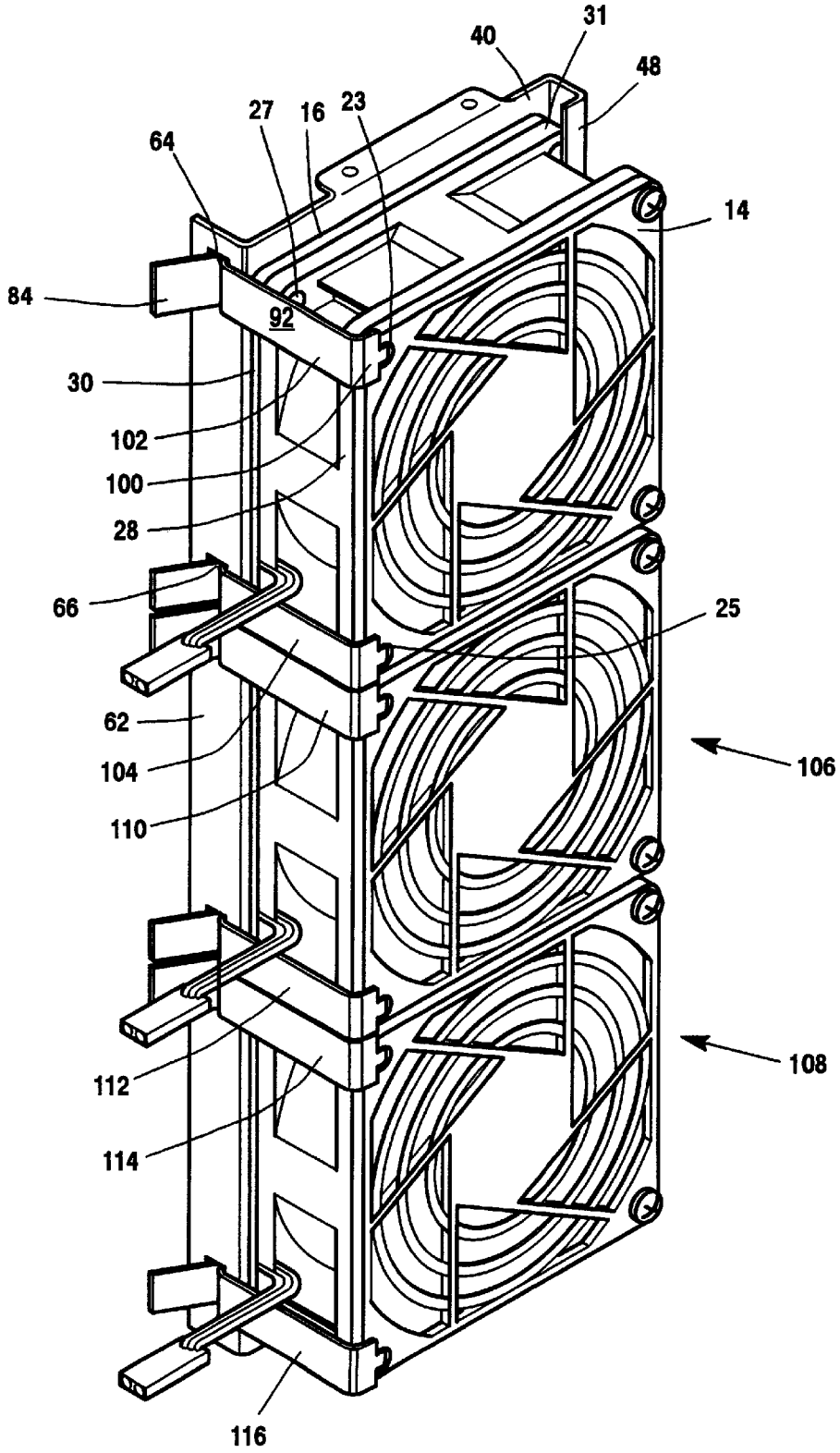
FIG. 3 is a perspective view of the frame of FIG. 2 with three fan assemblies of FIG. 1 secured to it.

The fan assembly shown in FIG. 1 is typical of the type of fans used to cool electronic equipment. They may be used either alone or in combination, as shown in FIG. 3. One suitable fan for such a purpose is the Flight II 80 Comair Roton fan.

The electrical fan assembly 10 of FIG. 1 has a plastic housing 12 with front and back sides 14, 16. The front side 14 consists of a finger guard plate 15 and the back side 16 (not shown) is designed to support the motor shaft of the fan and to allow for the flow of air from front to back in a conventional manner. The electrical fan (not shown) is housed in the housing 12 and its electrical cord 18 extends through a slot 20 in the housing. The finger guard plate 15 is secured to the housing 12 by the screws 22, 24, which are secured into threads in the housing 12 on one edge 26 of the housing 12. The back side 16 has two screw holes 27, 29 located on the edge 30 of the back side which are aligned with two screw holes 23, 25 in the corners of the finger guard plate 15 and the housing edge 28. Screw threads are provided in the housing to secure the finger guard plate 15 to the housing at the corners of the housing along the edge 28. However, screws are not utilized at these corners when a fan assembly is to be secured to a frame in accordance with the invention.

Figure 2:
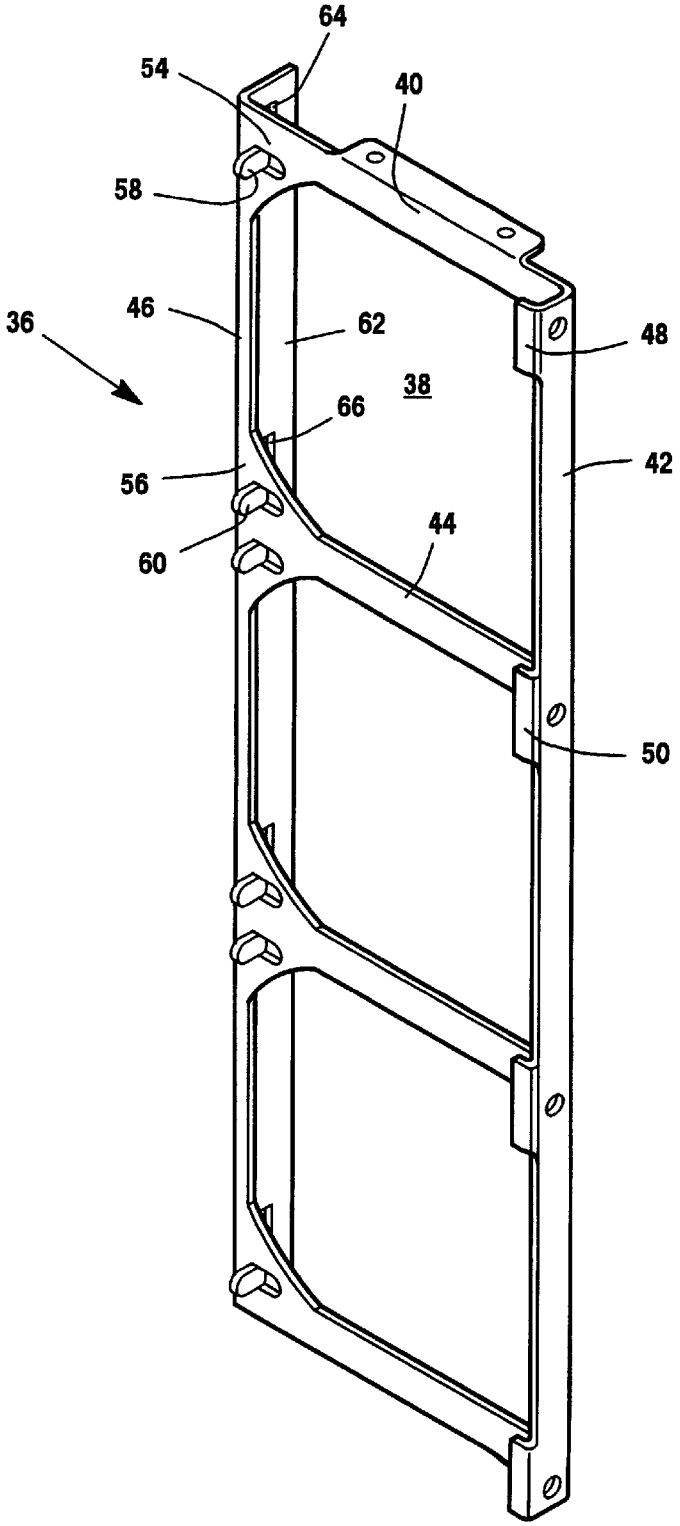
FIG. 2 is a perspective view of a frame adapted so that three of the fan assemblies of FIG. 1 may be secured to it.

A frame 36 for supporting three fan assemblies in a close-fitting column is shown in FIG. 2. Each fan assembly is to be positioned at one of the support stations of the frame. The uppermost fan support station is defined by the opening 38, which is surrounded by four frame sides 40, 42, 44 and 46. Frame sides 40, 44 and 46 all lie substantially in the same place. The generally rectangular side 42 extends in a substantially normal direction to the generally rectangular sides 40, 44. Two retaining ribs 48, 50 extend in a substantially normal direction from the side 42 and parallel to the sides 40, 44. These retaining ribs are used to retain a fan assembly in the frame, as will subsequently be described.

The side 46 has generally triangular-shaped areas 54, 56 at its ends, which join the sides 40 and 44, respectively. The areas 54, 56 are provided so that the tabs 58, 60 may be punched out of them so as to project in a normal direction from the areas 54, 56, respectively, in the same direction in which side 42 projects. The tabs 58, 60 extend into the corresponding holes 27, 29 in the fan housing. A wall 62 extends in a substantially normal direction opposite to the direction in which the side 42 extends. Two rectangular slots are provided in the wall 64, 66 each of which are located so that they are spaced apart at opposite ends of the frame side 46 for the opening 38, as shown in FIG. 3.

When a fan assembly is installed in the top fan assembly support station, as shown in FIG. 3, the back side 16 engages the forward-facing surfaces of the frame sides 40, 46, as viewed in FIG. 3, and the rear corners, such as the corner 31, of the fan housing 10 are wedged between these frame sides and the retaining ribs 48, 50 as the fan assembly is slid into place.

Figure 4:
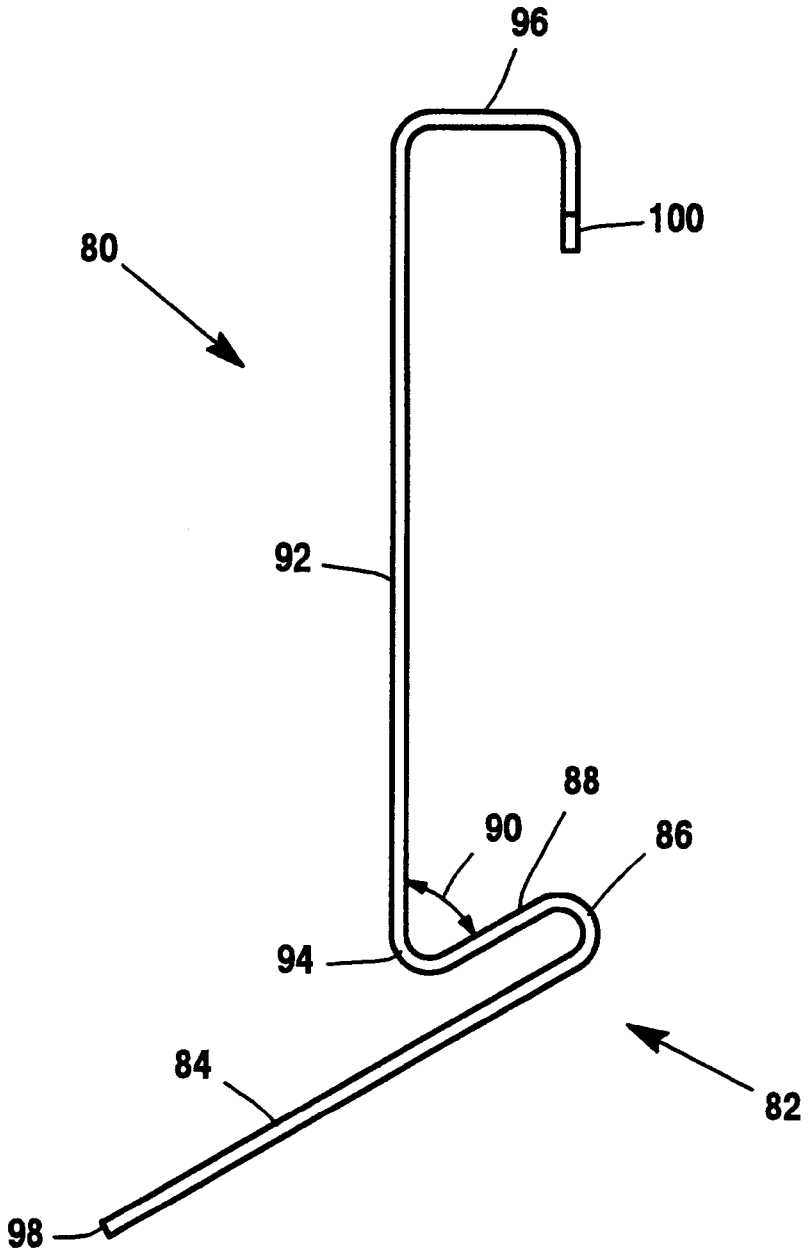
FIG. 4 is a side view of a spring clip that is used to secure the fan assemblies of FIG. 1 to the frame of FIG. 2.
Figure 5:
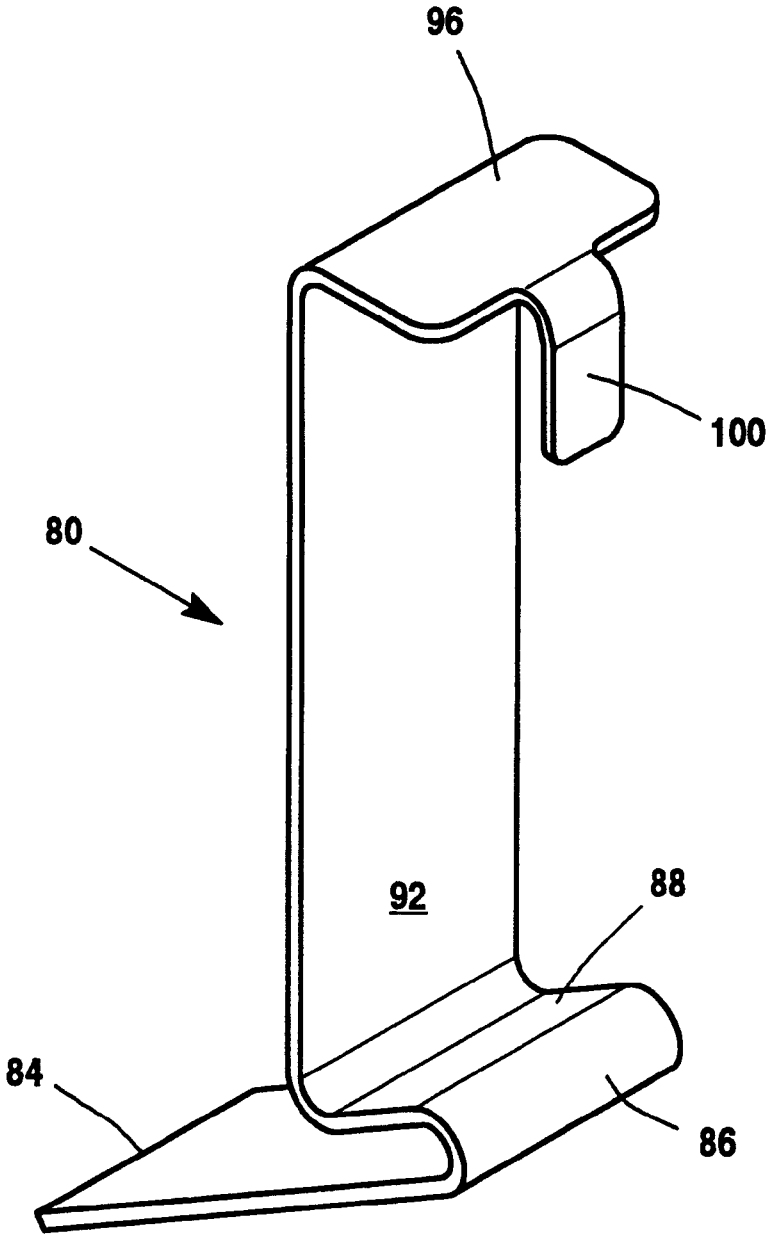
FIG. 5 is an isometric view of the spring clip of FIG. 4.

FIGS. 4 and 5 show spring clips which are used to complete the quick-change mechanism of the invention. The spring clip 80 is made of a single piece of spring steel. It is formed with a generally J-shaped portion 82 that consists of a relatively long straight leg 84, a U-shaped curved section

86 and a relatively shorter straight leg 88. The legs 84 and 88 run generally parallel to each other along a line that forms an acute angle 90 with the elongated flat, straight leg 92. A bent section 94 joins the legs 88 and 92. The end of the leg 92 that is remote from the curved section 94 joins short ledge 96 that extends in the direction away from the free end 98 of the leg 84. The ledge 96 is joined at its center by a lip 100 that is substantially narrower than the ledge, as shown in FIG. 5.

The use of the spring clips of FIGS. 4 and 5 to retain fan assemblies on the frame is shown in FIG. 3. For example, spring clip 102 is positioned so that its leg 92 is substantially normal to the front and back sides 14, 16. The lip 100 is positioned over the screw hole 23 so that the ledge 96 engages and conforms to the edge 28. The leg 92 then extends past the edge 30 and over part of the wall 62. The short leg 88, the curved section 86 and part of the long leg 84 is inserted into the slot 64 such that the legs 84 and 88 angle in toward the back side 16 of the fan assembly.

The spring clip 102 will be retained in the slot 64 because the unstressed distance between legs 88 and 84 is wider than the width of the slot 64. The legs 88, 84 must be moved closer together by pressure applied to the outer end 98 portion of the leg 84 to insert or remove the spring clip 102 from the slot 64, to allow removal of the lip 100 from the screw hole 23. The spring clip 104 is constructed the same as the spring clip 102 and acts in conjunction with the screw hole 25 and the slot 66 at the lower end of the fan assembly to complete the securing of the fan assembly onto the frame. The other fan assemblies 106, 108 are secured to the frame 36 in an identical manner with the spring clips 110–116. An inexpensive but effective way of securing fan assemblies to frames that allows for the rapid exchange of fan assemblies without the use of tools is thereby provided by the invention.

What is claimed is:

1. A mechanism for securing one or more electrical fan assemblies to a frame wherein each fan assembly comprises:

a generally rectangular-shaped block housing with a four-cornered front side with a first front edge that has a hole in each of the two spaced-apart corners of said first front edge, a four-cornered back side with a first back edge that has a hole in each of the two spaced-apart corners of said first back edge, wherein said first front edge and said first back edge are substantially in parallel alignment with each other, and said back side has a second back edge that is remote from said first back edge, said mechanism comprising:

(a) said frame being constructed with a generally flat frame peripheral section that surrounds a generally four-cornered rectangular opening at each of a fan support location where one of said fan assemblies is to be secured to said frame, two spaced-apart tabs punched out of said frame, said tabs projecting substantially normal to said frame peripheral sections and being located so that each tab is insertable into one of said holes in one of said corners of said back edge when said one fan assembly is mounted at the associated fan-support location, two spaced apart U-channel ribs formed from said frame which are each constructed and positioned to surround a limited portion of the second back edge of said one fan assembly when it is supported at the associated fan-support location, and said frame having a wall that extends away from said frame, which has a pair of spaced-apart slots extending therethrough which are each respectively located in alignment with one of said holes in one of said corners of said first front edge of the associated fan assembly and another of said holes in another of said corners of said first rear edge of the associated fan assembly when said associated fan assembly is secured at said fan-support location, and (b) first and second resilient spring clips, each associated with one of said slots and the holes with which a particular slot is aligned, wherein each spring clip comprises:

a curved first end at one end of said clip having a ledge and a lip of a substantially narrower dimension than said ledge, wherein said lip is clamped over the hole in the corner of said first front edge and said curved end conforms to said first front edge of said associated fan assembly, an elongated straight side that extends from said first curved end to the associated slot, a generally J-shaped section that extends from said elongated straight side which comprises a first relatively long leg that extends to a second end, a second relatively shorter straight side that joins with said elongated straight side such that said first and second legs run substantially parallel to each other at an acute angle relative to said elongated straight side, and a curved section that joins said first relatively longer leg and said second relatively shorter leg; said curved section and portions of said relatively shorter leg and said relatively longer leg being insertable into said slot by the application of force to said first relatively longer leg to reduce the spacing between said relatively longer leg and said relatively shorter leg so that when said pressure is released the spring clip is retained in said associated slot due to expansion of the space between the first relatively longer leg and the second relatively shorter leg.

* * * * *